US010079456B2

(12) United States Patent
Chen et al.

(10) Patent No.: US 10,079,456 B2
(45) Date of Patent: Sep. 18, 2018

(54) ELECTRICAL RECEPTACLE CONNECTOR

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Ruei-Si Hong, New Taipei (TW); Jing Li, New Taipei (TW); Fu-Yi Xu, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/624,167

(22) Filed: Jun. 15, 2017

(65) Prior Publication Data

US 2017/0365954 A1 Dec. 21, 2017

(30) Foreign Application Priority Data

Jun. 17, 2016 (CN) ..... 2016 1 0429479

(51) Int. Cl.

| | |
|---|---|
| ***H01R 24/00*** | (2011.01) |
| ***H01R 13/6461*** | (2011.01) |
| ***H01R 24/60*** | (2011.01) |
| ***H01R 13/6585*** | (2011.01) |
| *H01R 12/72* | (2011.01) |

(52) U.S. Cl.
CPC ..... *H01R 13/6461* (2013.01); *H01R 13/6585* (2013.01); *H01R 24/60* (2013.01); *H01R 12/724* (2013.01)

(58) Field of Classification Search
CPC ..... H01R 33/22
USPC ..... 439/676, 660, 607.35, 607.4
See application file for complete search history.

(56) References Cited

U.S. PATENT DOCUMENTS

2013/0323976 A1* 12/2013 Tsai ..... H01R 43/16 439/626
2015/0340791 A1* 11/2015 Kao ..... H01R 24/60 439/676

* cited by examiner

*Primary Examiner* — Phuong Dinh
(74) *Attorney, Agent, or Firm* — Muncy, Geissler, Olds & Lowe, P.C.

(57) ABSTRACT

An electrical receptacle connector includes a metallic shell, an insulated housing, upper-row receptacle terminals, and lower-row receptacle terminals. The insulated housing is in the receptacle cavity of the metallic shell. The receptacle terminals are held in the base portion and the tongue portion. The tail portions of the power terminals and the tail portions of the ground terminals have three bent portions, i.e., the first bent portion, the second bent portion, and the third bent portion. The bent portions allow the terminals to have different and non-parallel delivering paths for electromagnetic waves, so that the signals do not interfere with each other easily.

13 Claims, 12 Drawing Sheets

ELECTRICAL RECEPTACLE CONNECTOR

CROSS-REFERENCE TO RELATED APPLICATION

This non-provisional application claims priority under 35 U.S.C. § 119(a) to Patent Application No. 201610429479.X filed in China, P.R.C. on Jun. 17, 2016, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

In order to transmit USB 3.0 signals, the conventional USB receptacle connector has to eliminate the signal interference by conduction and grounding during high-speed signal transmission. A conventional receptacle connector adapted for transmitting USB 2.0 includes an insulated housing, upper-row and lower-row terminals, and an iron shell. The terminals are disposed on the insulated housing, and the insulated housing is inside the iron shell. In the conventional, the terminals are connected to a circuit board to perform the conduction and grounding, and the iron shell includes several shielding plates connecting to the circuit board to perform the conduction and the grounding.

SUMMARY OF THE INVENTION

In the conventional, the end portions of the terminals are configured in two or more rows and arranged in a staggered manner. The end portion of the terminal does not have bent portion, and the delivering path for electromagnetic wave cannot be changed, resulting in the interference of the electromagnetic waves from different terminals during signal transmission. Therefore, how to solve the aforementioned problem is an issue.

In view of this, an embodiment of the instant disclosure provides an electrical receptacle connector. The electrical receptacle connector comprises a metallic shell, an insulated housing, a plurality of upper-row receptacle terminals, and a plurality of lower-row receptacle terminals. The metallic shell comprises a receptacle cavity. The insulated housing is in the receptacle cavity. The insulated housing comprises a base portion and a tongue portion extending from one end of the base portion. The upper-row receptacle terminals comprise a plurality of upper-row signal terminals, a plurality of upper-row power terminals, and a plurality of upper-row ground terminals. The upper-row receptacle terminals are held in the base portion and the tongue portion. The lower-row receptacle terminals comprise a plurality of lower-row signal terminals, a plurality of lower-row power terminals, and a plurality of lower-row ground terminals. The lower-row receptacle terminals are held in the base portion and the tongue portion. Each of the lower-row receptacle terminals further comprises a first bent portion and a tail portion outwardly extending from the first bent portion and protruding from the base portion. The tail portion is a vertical leg. The tail portion of each of the lower-row power terminals has a second bent portion and a third bent portion, and the tail portion of each of the lower-row ground terminals has a second bent portion and a third bent portion. The tail portions of the lower-row signal terminals protrude from a bottom of the base portion to be arranged into a first row. The tail portions of the lower-row power terminals and the tail portions of the lower-row ground terminals protrude from the bottom of the base portion to be arranged into a second row, a position of the second row is different from a position of the first row.

As above, the tail portions of the power terminals and the tail portions of the ground terminals have three bent portions, i.e., the first bent portion, the second bent portion, and the third bent portion. The bent portions allow the terminals to have different and non-parallel delivering paths for electromagnetic waves, so that the signals do not interfere with each other easily. Moreover, after a first bending procedure, the lower-row receptacle terminals are aligned in a same row, and the first bent portions of the lower-row receptacle terminals are spaced and aligned in a same line. The cross-talk interferences between different pairs of differential signal terminals can be reduced by using non-signal terminals neighboring to the differential signal terminals to separate the different pairs of differential signal terminals. Furthermore, problems caused by the resonance effect can also be reduced. Additionally, regarding the structure of the tail portions of the lower-row receptacle terminals, the material band and the tail portions in vertical alignment are at a same plane; namely, the material band is parallel to the tail portions. Therefore, the volume of the connector can be reduced, so that the electronic device can have still have enough space after the connector is assembled to the electronic device. Moreover, the space between the tail portions allows the tools to be inserted for processing conveniently, so that the manufacturing of the connector can be facilitated.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the upper-row receptacle terminals are in contact with upper-row plug terminals of the electrical plug connector. Conversely, when the electrical plug connector is inserted into the electrical receptacle connector with a second orientation, the flat contact portions of the lower-row receptacle terminals are in contact with the upper-row plug terminals of the electrical plug connector.

Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
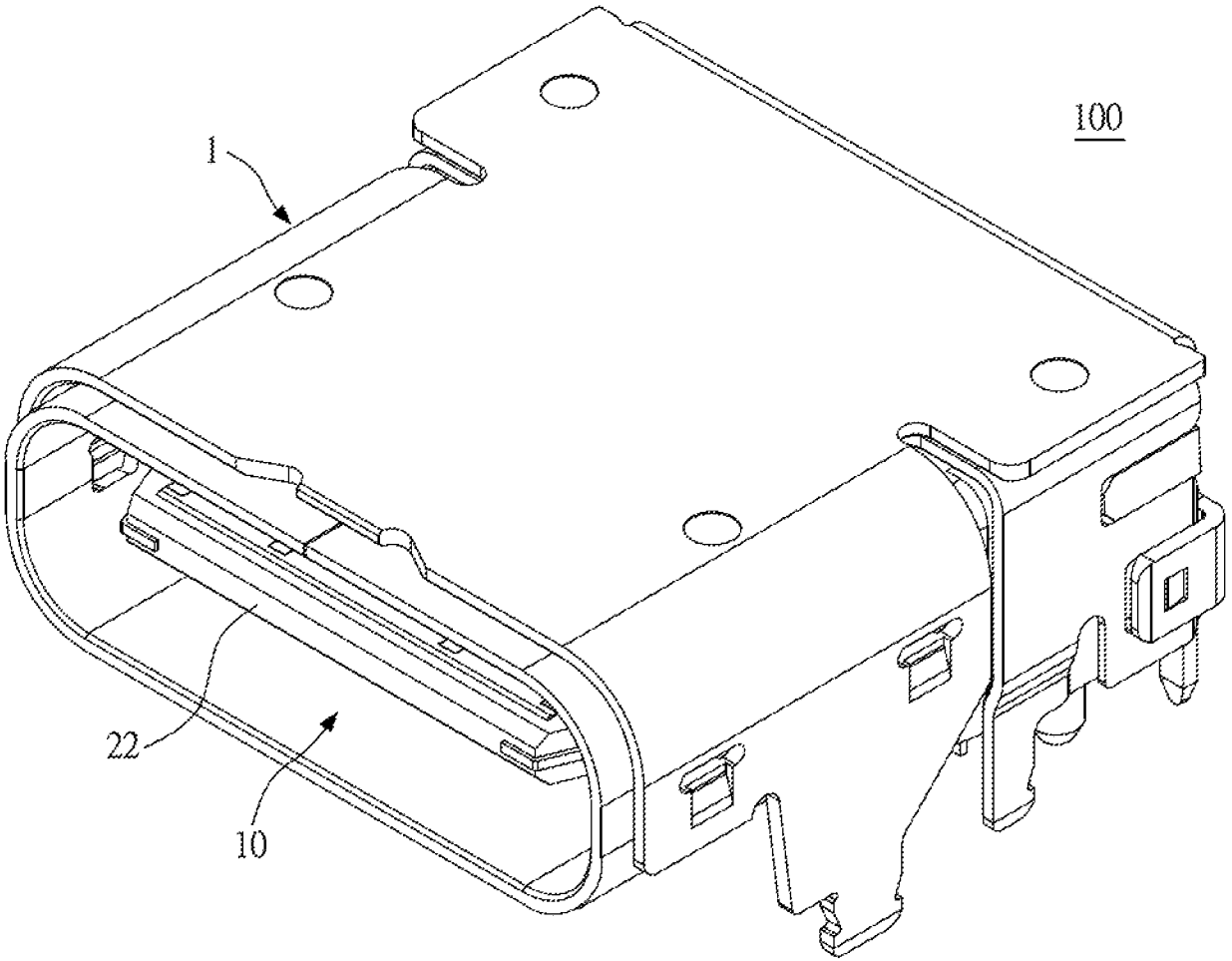
FIG. 1 illustrates a perspective view of an electrical receptacle connector of a first embodiment of the instant disclosure.
Figure 2:
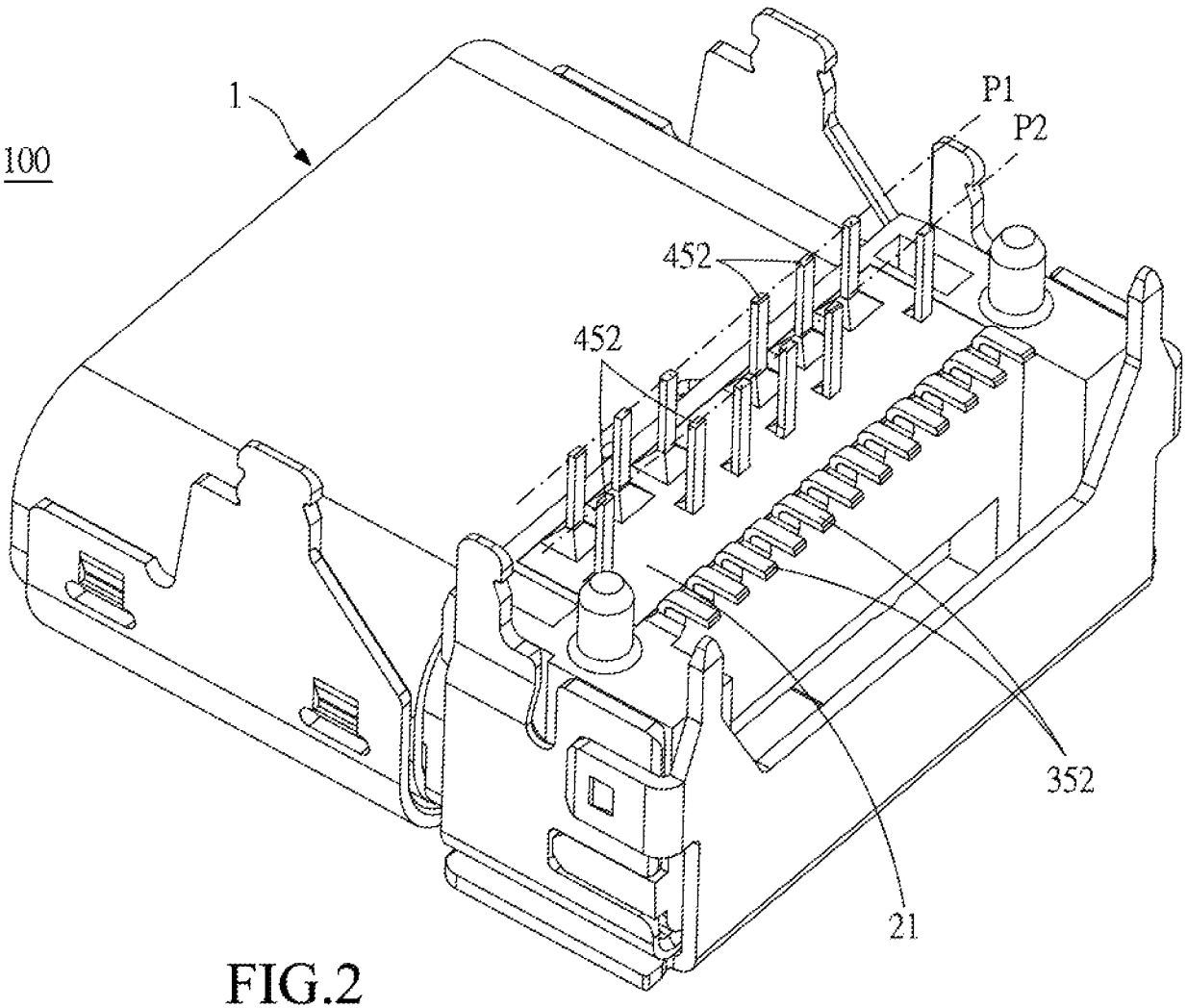
FIG. 2 illustrates another perspective view of the electrical receptacle connector of the first embodiment.
Figure 3:
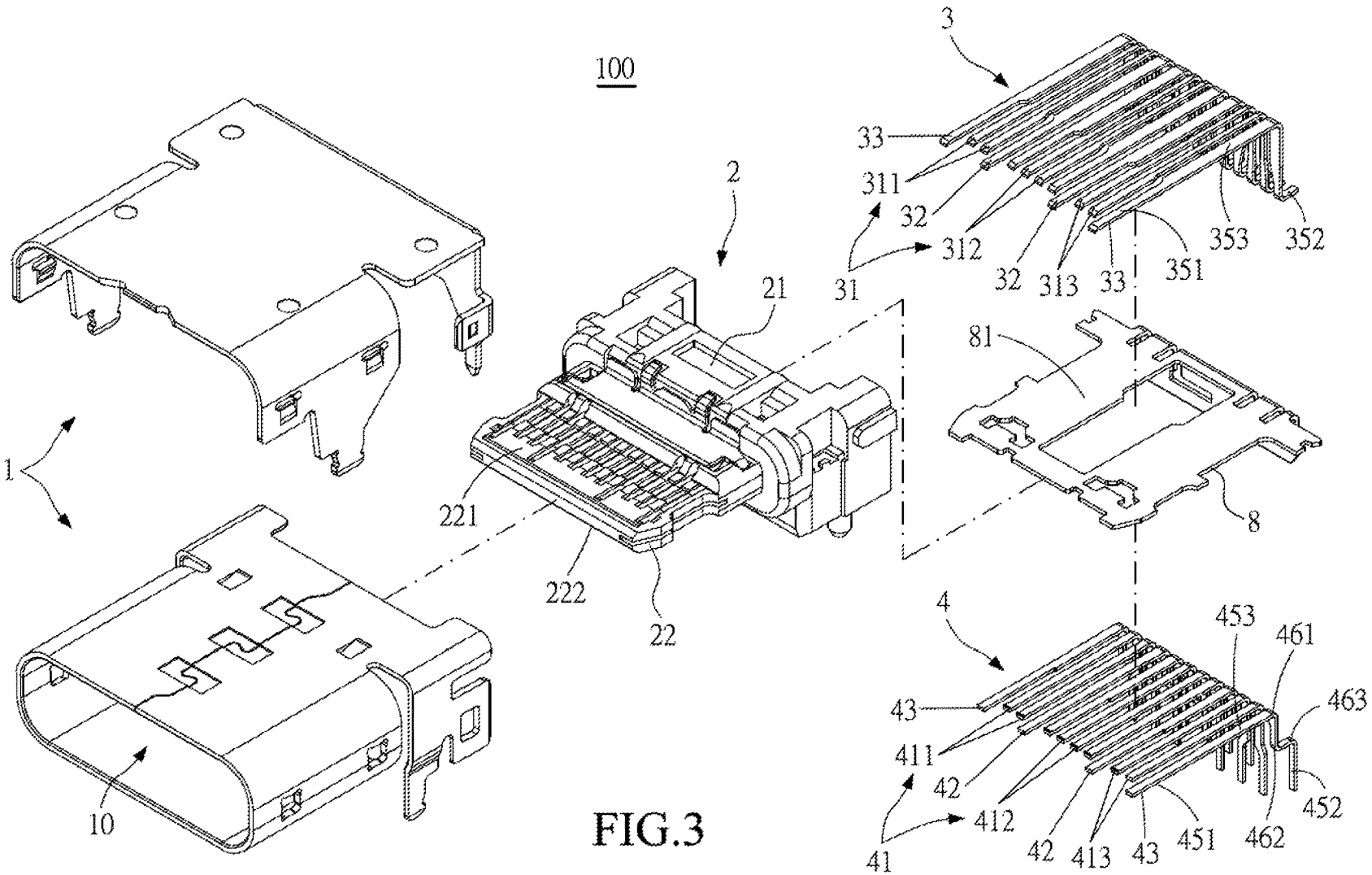
FIG. 3 illustrates an exploded view of the electrical receptacle connector of the first embodiment.
Figure 4:
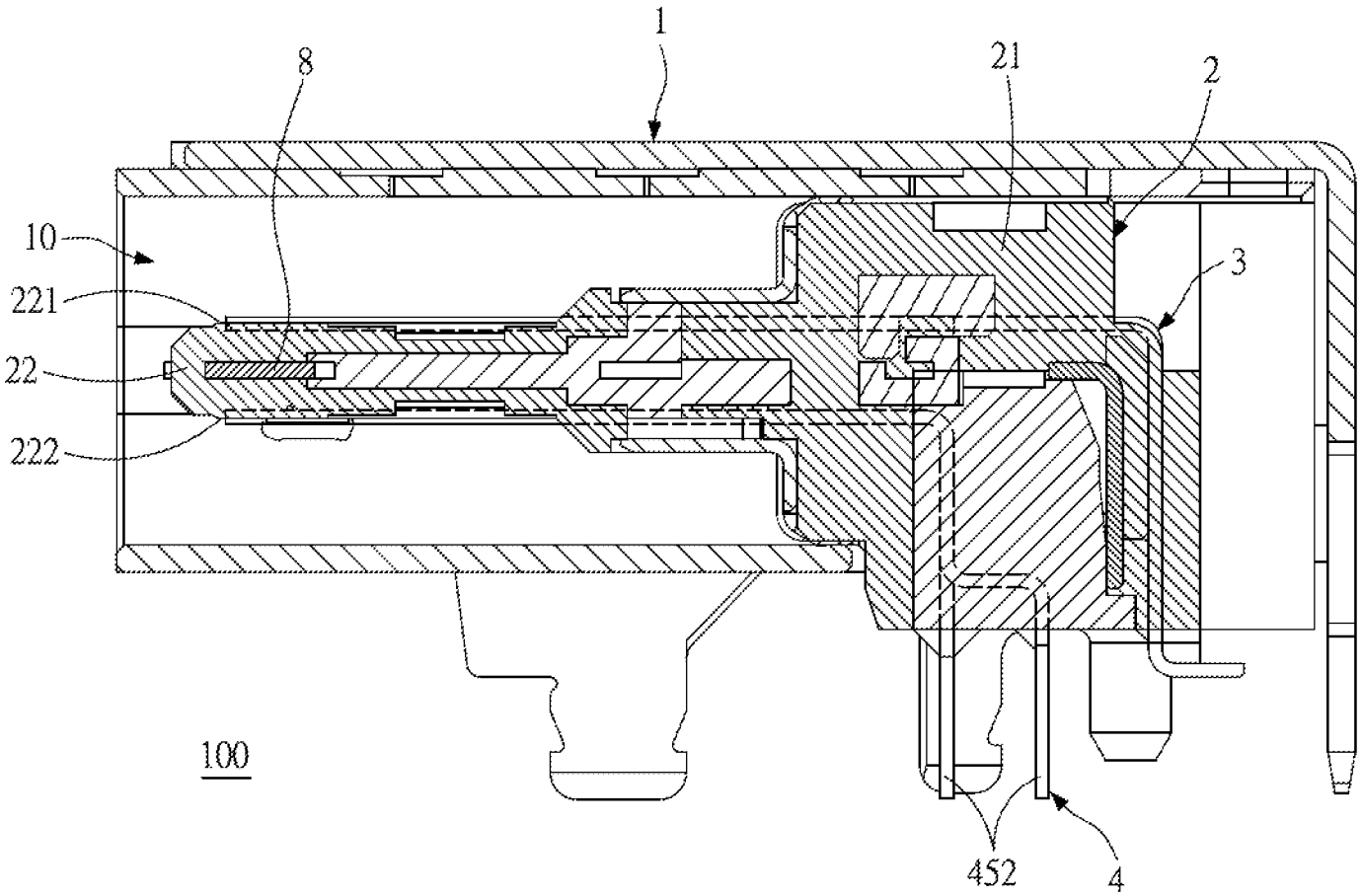
FIG. 4 illustrates a lateral sectional view of the electrical receptacle connector of the first embodiment.

FIG. 1 illustrates a perspective view of an electrical receptacle connector of a first embodiment of the instant disclosure. FIG. 2 illustrates another perspective view of the electrical receptacle connector of the first embodiment. FIG. 3 illustrates an exploded view of the electrical receptacle connector of the first embodiment. FIG. 4 illustrates a lateral sectional view of the electrical receptacle connector of the first embodiment. Please refer to FIGS. 1 to 4, illustrating an electrical receptacle connector of a first embodiment of the instant disclosure. The electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 1, an insulated housing 2, a plurality of upper-row receptacle terminals 3, and a plurality of lower-row receptacle terminals 4.

Please refer to FIGS. 1 to 4. The metallic shell 1 is a hollowed shell, and the metallic shell 1 has a receptacle cavity 10 for receiving the insulated housing 2. In this embodiment, the front portion of the metallic shell 1 has an insertion opening for the insertion of an electrical plug connector, and a plurality of legs extends from the rear portion of the metallic shell 1 for contacting a circuit board.

Please refer to FIGS. 3 and 4. The insulated housing 2 comprises a base portion 21 and a tongue portion 22, and the insulated housing 2 may be a unitary member or a multi-piece member. In addition, the tongue portion 22 extends from one end of the base portion 21, and the tongue portion 22 has an upper surface 221 and a lower surface 222 opposite to the upper surface 221.

Please refer to FIGS. 3 and 4. In this embodiment, the upper-row receptacle terminals 3 are held in the base portion 21 and the tongue portion 22. Each of the upper-row receptacle terminals 3 comprises a flat contact portion 351, a body portion 353, and a tail portion 352. For each of the upper-row receptacle terminals 3, the body portion 353 is held in the base portion 21 and the tongue portion 22, the flat contact portion 35 extends forward from the body portion 353 in the rear-to-front direction and is partly exposed upon the upper surface of the tongue portion 22, and the tail portion 352 extends backward from the body portion 353 in the front-to-rear direction and protrudes from the base portion 21. The tail portions 352 extend from the body portions 353 and are bent horizontally to form flat legs, named legs manufactured by SMT (surface mount technology), which can be mounted or soldered on the surface of a printed circuit board by using surface mount technology. In another embodiment, the tail portions 352 may extend from the body portions 353 downwardly to form vertical legs, named legs manufactured by through-hole technology, which can be inserted into holes drilled in a printed circuit board (PCB). Moreover, the tail portions 352 protrude from the base portion 21, e.g., the tail portions 352 protrude from the bottom surface of the base portion 21. In addition, the tail portions 352 are aligned in a row.

Figure 5A:
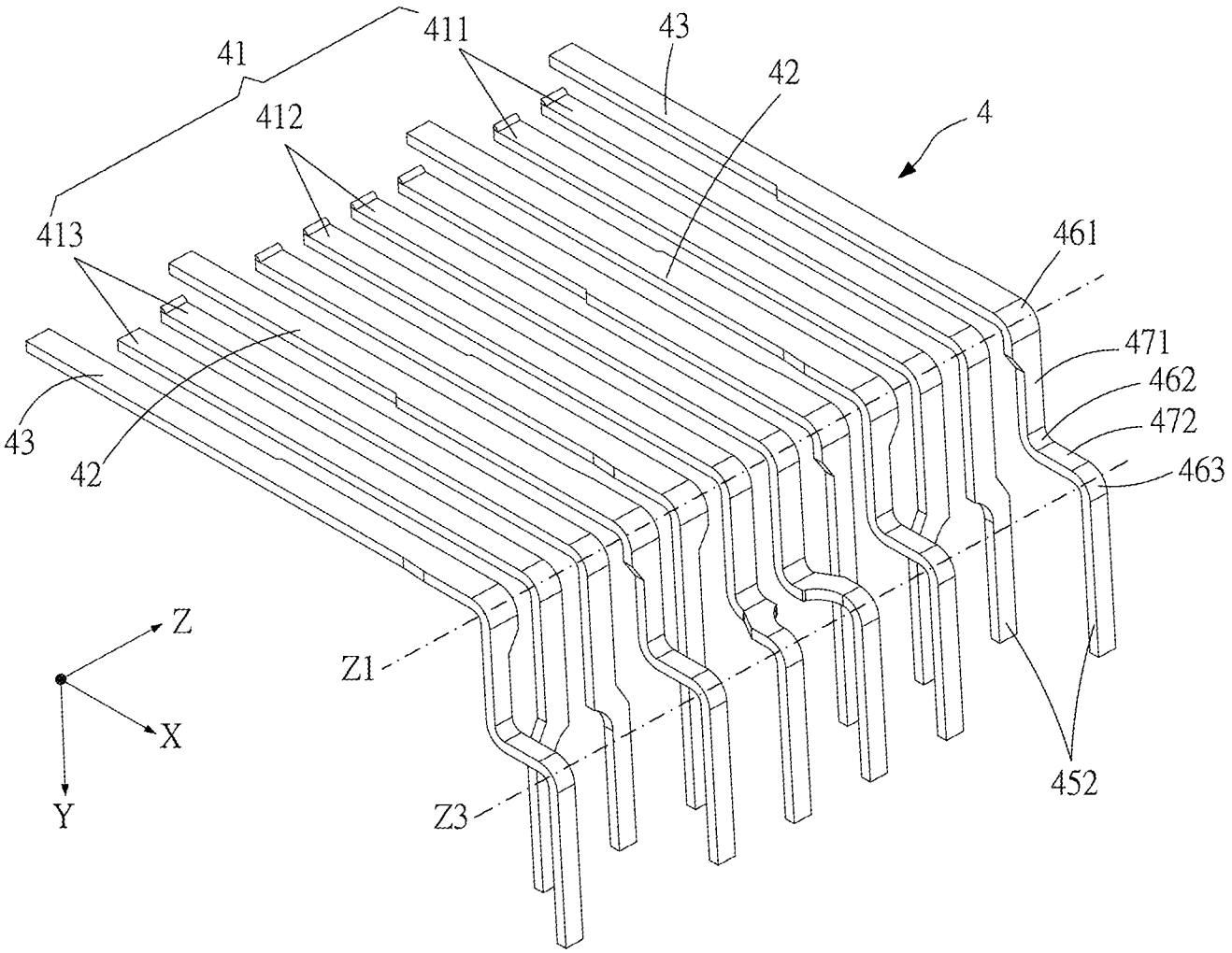
FIG. 5A illustrates a perspective view of lower-row receptacle terminals of the electrical receptacle connector of the first embodiment.
Figure 5B:
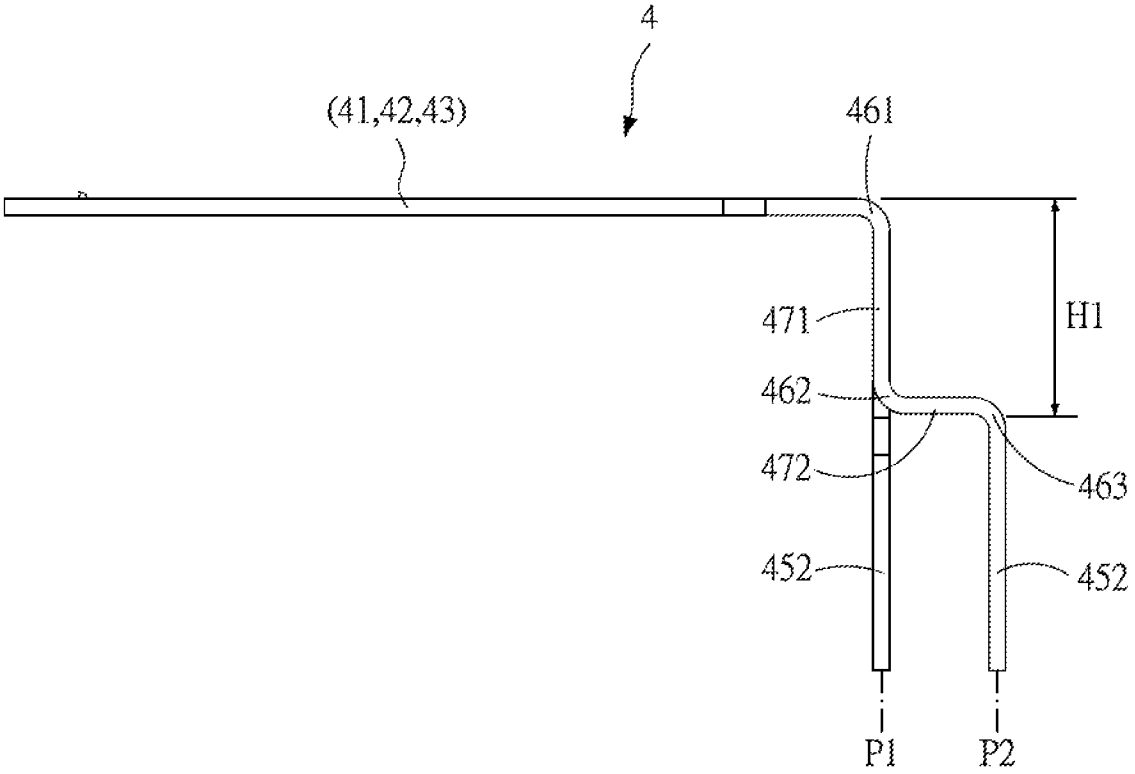
FIG. 5B illustrates a lateral view of the lower-row receptacle terminals of the electrical receptacle connector of the first embodiment.

Please refer to FIGS. 3, 4, 5A, and 5B. FIG. 5A illustrates a perspective view of lower-row receptacle terminals of the electrical receptacle connector of the first embodiment. FIG. 5B illustrates a lateral view of the lower-row receptacle terminals of the electrical receptacle connector of the first embodiment. In this embodiment, the lower-row receptacle terminals 4 are held in the base portion 21 and the tongue portion 22. Each of the lower-row receptacle terminals 4 comprises a flat contact portion 451, a body portion 453, and a tail portion 452. For each of the lower-row receptacle terminals 4, the body portion 453 is held in the base portion 21 and the tongue portion 22, the flat contact portion 451 extends from the body portion 453 in the rear-to-front direction and is partly exposed upon the lower surface 222 of the tongue portion 22, and the tail portion 416 extends backward from the body portion 453 in the front-to-rear direction and protrudes from the base portion 21. In addition, the tail portions 452 protrude from the base portion 21, e.g., the tail portions 452 protrude from the bottom surface of the base portion 21. In addition, the tail portions 452 are aligned into a first row P1 and a second row P2. The tail portions 452 form vertical legs.

Please refer to FIGS. 3 and 4. In this embodiment, the tail portions 352, 452 protrude from the base portion 21 and aligned separately. The alignment for the tail portions 352, 452 may be the tail portions 352 form one row and the tail portions 452 form two rows.

Please refer to FIGS. 3 and 4. In this embodiment, the upper-row receptacle terminals 3 comprise a plurality of upper-row signal terminals 31, a plurality of power terminals 32, and a plurality of ground terminals 33. The upper-row signal terminals 31 are disposed on the upper surface 221 and transmit first signals (namely, USB 3.0 signals). From a front view of the upper-row receptacle terminals 3, the upper-row receptacle terminals 3 comprise, from left to right, a ground terminal 33 (Gnd), a first pair of differential signal terminals 311 (TX1+–, differential signal terminals for high-speed signal transmission) of the upper-row signal terminals 31, a power terminal 32 (Power/VBUS), a second pair of differential signal terminals 312 (D+–, differential signal terminals for low-speed signal transmission) of the upper-row signal terminals 31, an RFU (reserved for future use) terminal, another power terminal 32 (Power/VBUS), a third pair of differential signal terminals 313 (RX2+–, differential signal terminals for high-speed signal transmission), and another ground terminal 33 (Gnd). It is understood that the terminal arrangement are not limited. In this embodiment, twelve upper-row receptacle terminals 3 are provided for transmitting USB 3.0 signals, but embodiments are not limited thereto. In one embodiment, the rightmost ground terminal 33 (Gnd) (or the leftmost ground terminal 33 (Gnd)) or the RFU terminal can be further omitted. Furthermore, the ground terminal 33 (Gnd) may be replaced by a power terminal 32 (Power/VBUS) and provided for power transmission.

Please refer to FIGS. 3, 4, 5A, and 5B. In this embodiment, the lower-row receptacle terminals 4 comprise a plurality of lower-row signal terminals 41, a plurality of power terminals 42, and a plurality of ground terminals 43. The lower-row signal terminals 41 are disposed on the lower surface 222 and transmit second signals (namely, USB 3.0 signals). From a front view of the lower-row receptacle terminals 4, the lower-row receptacle terminals 4 comprise, from right to left, a ground terminal 43 (Gnd), a first pair of differential signal terminals 411 (TX2+–, differential signal terminals for high-speed signal transmission) of the lower-row signal terminals 41, a power terminal 42 (Power/VBUS), a second pair of differential signal terminals 412 (D+–, differential signal terminals for low-speed signal transmission) of the lower-row signal terminals 41, an RFU terminal, another power terminal 42 (Power/VBUS), a third pair of differential signal terminals 413 (RX1+–, differential signal terminals for high-speed signal transmission), and another ground terminal 43 (Gnd). It is understood that the terminal arrangement are not limited. In this embodiment, twelve lower-row receptacle terminals 4 are provided for transmitting USB 3.0 signals, but embodiments are not limited thereto. In one embodiment, the rightmost ground terminal 43 (Gnd) (or the leftmost ground terminal 43 (Gnd)) or the RFU terminal can be further omitted. Furthermore, the ground terminal 43 (Gnd) may be replaced by a power terminal 42 (Power/VBUS) and provided for power transmission.

In the foregoing embodiments, the receptacle terminals 3, 4 are provided for transmitting USB 3.0 signals, but embodiments are not limited thereto. In some embodiments, for the upper-row receptacle terminals 3 in accordance with transmission of USB 2.0 signals, the first pair of differential signal terminals 311 (TX1+–) and the third pair of differential signal terminals 313 (RX2+–) are omitted, and the second pair of differential signal terminals 312 (D+–) and the power terminals 32 (Power/VBUS) are retained. While for the lower-row receptacle terminals 4 in accordance with transmission of USB 2.0 signals, the first pair of differential signal terminals 411 (TX2+–) and the third pair of differential signal terminals 413 (RX1+–) are omitted, and the second pair of differential signal terminals 412 (D+–) and the power terminals 42 (Power/VBUS) are retained.

Please refer to FIGS. 3 and 4. In this embodiment, the upper-row receptacle terminals 3 and the lower-row receptacle terminals 4 are disposed upon the upper surface 221 and the lower surface 222 of the tongue portion 22, respectively, and pin-assignments of the upper-row receptacle terminals 3 and the lower-row receptacle terminals 4 are point-symmetrical with a central point of the receptacle cavity 10 as the symmetrical center. In other words, pin-assignments of the upper-row receptacle terminals 3 and the lower-row receptacle terminals 4 have 180-degree symmetrical design with respect to the central point of the receptacle cavity 10 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the upper-row receptacle terminals 3 (or the lower-row receptacle terminals 4), are rotated by 180 degrees with the symmetrical center as the rotating center, the upper-row receptacle terminals 3 and the lower-row receptacle terminals 4 are overlapped. That is, the rotated upper-row receptacle terminals 3 are arranged at the position of the original lower-row receptacle terminals 4, and the rotated lower-row receptacle terminals 4 are arranged at the position of the original upper-row receptacle terminals 3. In other words, the upper-row receptacle terminals 3 and the lower-row receptacle terminals 4 are arranged upside down, and the pin assignments of the flat contact portions 351 are left-right reversal with respect to that of the flat contact portions 451. An electrical plug connector is inserted into the electrical receptacle connector 100 with a first orientation where the upper surface 221 is facing up, for transmitting first signals. Conversely, the electrical plug connector is inserted into the electrical receptacle connector 100 with a second orientation where the upper surface 221 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

In this embodiment, from a front view of the receptacle terminals 3, 4, the position of the upper-row receptacle terminals 3 corresponds to the position of the lower-row receptacle terminals 4.

Please refer to FIGS. 2 and 5A. In this embodiment, each of the lower-row receptacle terminals 4 further comprises a first bent portion 461, and the tail portion 452 outwardly extends from the first bent portion 461 and protruding from the base portion 21. The flat contact portion 451 extends in the X axis, the tail portion 452 extends in the Y axis, and the first bent portion 461 is a corner structure.

Please refer to FIGS. 2 and 5A. In this embodiment, each of the tail portions 452 is a vertical leg. The tail portion 452 of each of the power terminals 42 has a second bent portion 462 and a third bent portion 463, and the tail portion 452 of each of the ground terminals 43 has a second bent portion 462 and a third bent portion 463. For the tail portion 452 of the power terminal 42 and the tail portion 452 of the ground terminal 43, the tail portion 452 may be further divided into three parts, a first part and a third part respectively extend from two ends of a second part, the first part is upwardly extended toward the body portion 453 from the second part, and the third part is downwardly extended toward the end portion of the tail portion 452 from the second part. In other words, a stood portion 471 (extending along the Y axis) is defined between the first bent portion 461 and the second bent portion 462, and a laid portion 472 (extending along the X axis) is defined between the second bent portion 462 and the third bent portion 463. From a lateral view, an angle between the stood portion 471 and the laid portion 472 is substantially a right angle.

Please refer to FIGS. 2 and 5A. In this embodiment, the tail portion 452 of each of the terminals of the second pair of differential signal terminals 412 has a second bent portion 462 and a third portion 463. In other words, the tail portion 452 of each of the second pair of differential signal terminals 412 also has a configuration similar to the tail portion 452 of the power terminal 42 (or the tail portion 452 of the ground terminal 43). Namely, the tail portion 452 of each of the second pair of differential signal terminals 412 also has three bent portions.

Please refer to FIGS. 2, 5A, and 5B. In this embodiment, the tail portion 452 of each of the lower-row signal terminals 41 protrudes from the bottom of the base portion 21 to be arranged into a first row P1, and the tail portion 452 of each of the power terminals 42 and the tail portion 452 of each of the ground terminals 43 protrude from the bottom of the base portion 21 to be arranged into a second row P2 different from the first row P1.

Please refer to FIGS. 2, 5A, and 5B. In this embodiment, the first bent portions 461 are spaced and aligned in a same line. In other words, the first bent portions 461 are aligned in a first axis Z1 (extending from the Z axis) and spaced with each other in equal distances. In addition, the crosstalk interferences between different pairs of differential signal terminals can be reduced by using non-signal terminals neighboring to the differential signal terminals to separate the different pairs of differential signal terminals. Furthermore, problems caused by the resonance effect can also be reduced. In other words, please refer to FIG. 8B, the tail portions 452 of the power terminals 42 and the tail portions 452 of the ground terminals 43 are spaced from the tail portions 452 of the lower-row signal terminals 41. The first bent portions 461 of the lower-row receptacle terminals 4 are located at different lines. Hence, the space between the tail portions 452 of the lower-row receptacle terminals 4 form a resonant cavity, and crosstalk between the differential signal terminals for high speed transmission may be interfered with each other. On the other hand, in this embodiment, the tail portions 452 of the power terminals 42 and the tail portions 452 of the ground terminals 43 also have the three bent portions, i.e., the first bent portion 461, the second bent portion 462, and the third bent portion 463. Hence, the bent portions allow the terminals to have different and non-parallel delivering paths for electromagnetic waves, so that the signals do not interfere with each other easily. As shown in FIGS. 5A and 5B, the third bent portions 463 of the power terminals 42, the third bent portions 463 of ground terminals 43, and third bent portion 463 of the second pair of differential signal terminals 412 are substantially aligned in a same line, a third axis Z3 (extending from the Z axis).

Please refer to FIGS. 3 and 4. In this embodiment, the electrical receptacle connector 100 further comprises a shielding plate 8. The shielding plate 8 is held in the insulated housing 2. A plate body 81 of the shielding plate 8 is between the flat contact portions 351 of the upper-row receptacle terminals 3 and the flat contact portions 451 of the lower-row receptacle terminals 4. In other words, the plate body 81 is formed in the base portion 21 and the tongue portion 22 and located between the flat contact portions 351 of the upper-row receptacle terminals 3 and the flat contact portions 451 of the lower-row receptacle terminals 4. Two sides of the plate body 81 respectively protrude from the base portion 21 and in contact with the metallic shell 1. The crosstalk interference can be reduced by the shielding of the shielding plate 8 when the flat contact portions 351, 451 transmit signals. Furthermore, the structural strength of the tongue portion 22 can be improved by the assembly of the shielding plate 8. In this embodiment, when the upper-row receptacle terminals 3 and the lower-row receptacle terminals 4 transmit USB 3.0 signals, the noise may be efficiently conducted and grounded by the contact between the shielding plate 8 and the metallic shell 1.

Figure 6A:
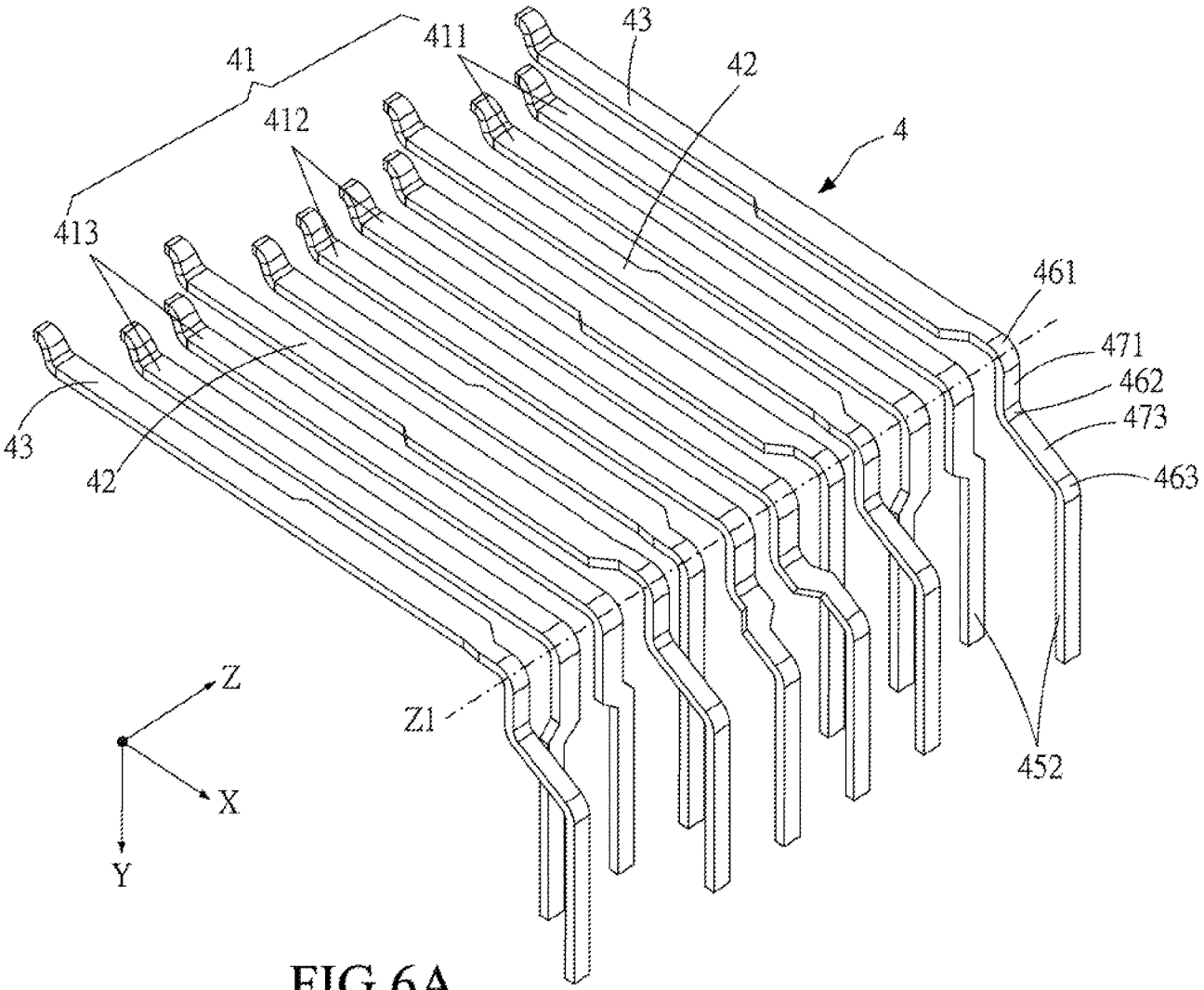
FIG. 6A illustrates a perspective view of lower-row receptacle terminals of an electrical receptacle connector of a second embodiment of the instant disclosure.
Figure 6B:
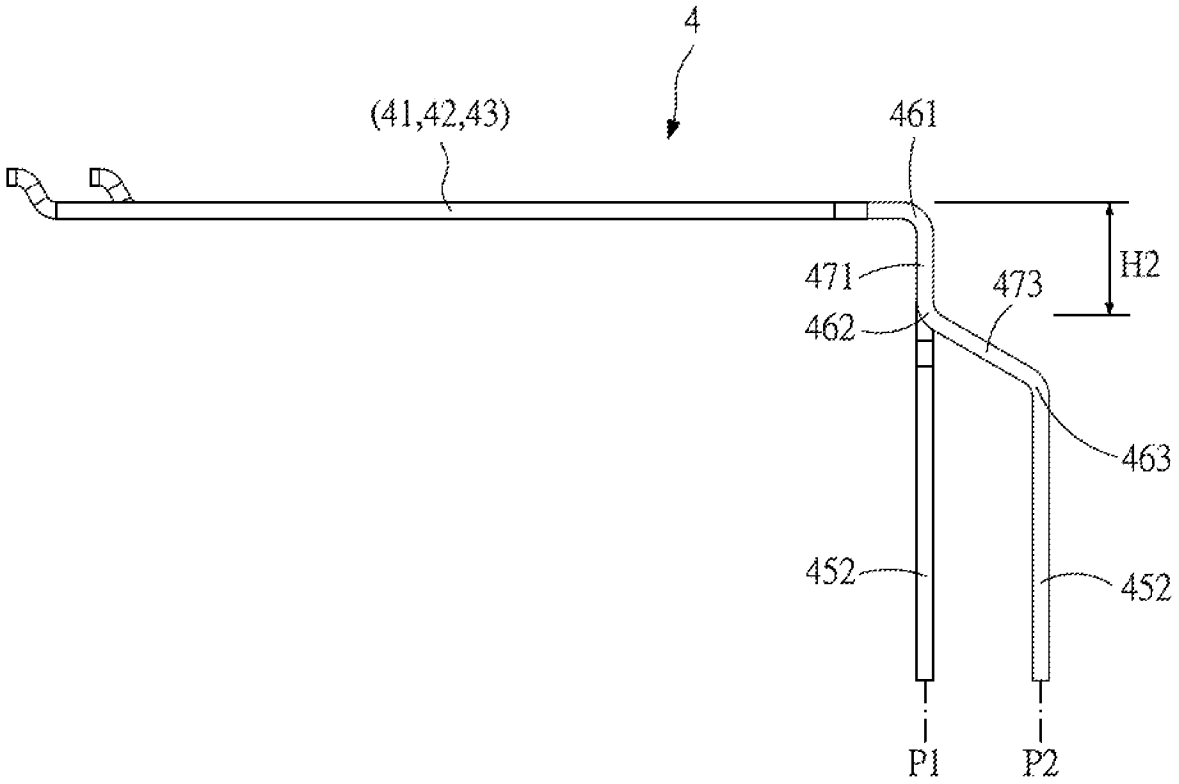
FIG. 6B illustrates a lateral view of the lower-row receptacle terminals of the electrical receptacle connector of the second embodiment.

Please refer to FIGS. 6A and 6B. FIG. 6A illustrates a perspective view of lower-row receptacle terminals of an electrical receptacle connector of a second embodiment of the instant disclosure. FIG. 6B illustrates a lateral view of the lower-row receptacle terminals of the electrical receptacle connector of the second embodiment. FIGS. 6A and 6B illustrate a second embodiment of an electrical receptacle connector of the instant disclosure. In this embodiment, a stood portion 471 is defined between the first bent portion 461 and the second bent portion 462, an outward-tilting portion 473 is defined between the second bent portion 462 and the third bent portion 463, the outward-tilting portion 473 extends outwardly, and the stood portion 471 and the outward-tilting portion 472 form an obtuse angle. In this embodiment, the tail portions 452 of the power terminals 42 and the tail portions 452 of the ground terminals 43 also have three bent portions, i.e., the first bent portion 461, the second bent portion 462, and the third bent portion 463. Hence, the bent portions allow the terminals to have different and non-parallel delivering paths for electromagnetic waves, so that the signals do not interfere with each other easily.

Figure 7A:
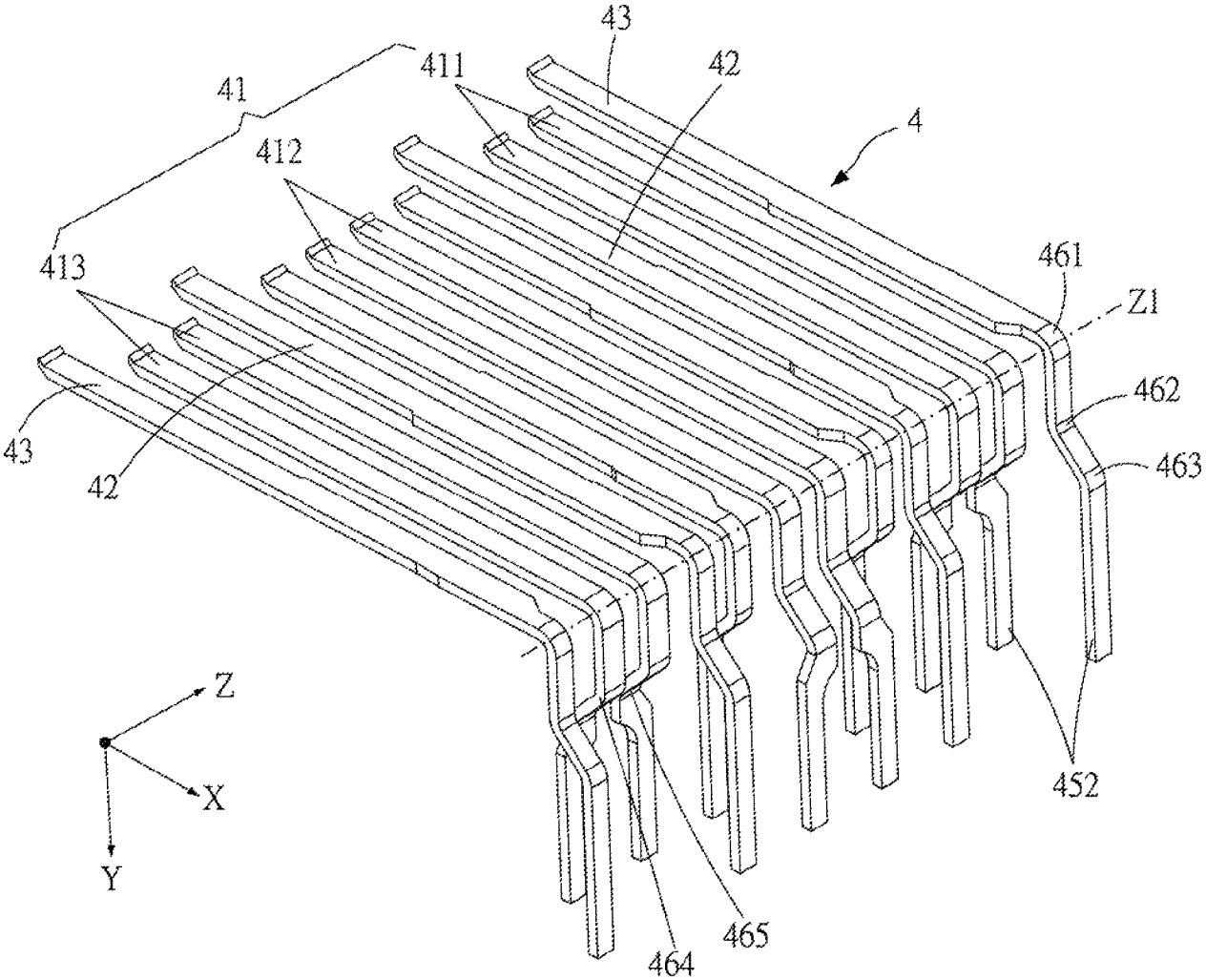
FIG. 7A illustrates a perspective view of lower-row receptacle terminals of an electrical receptacle connector of a third embodiment of the instant disclosure.
Figure 7B:
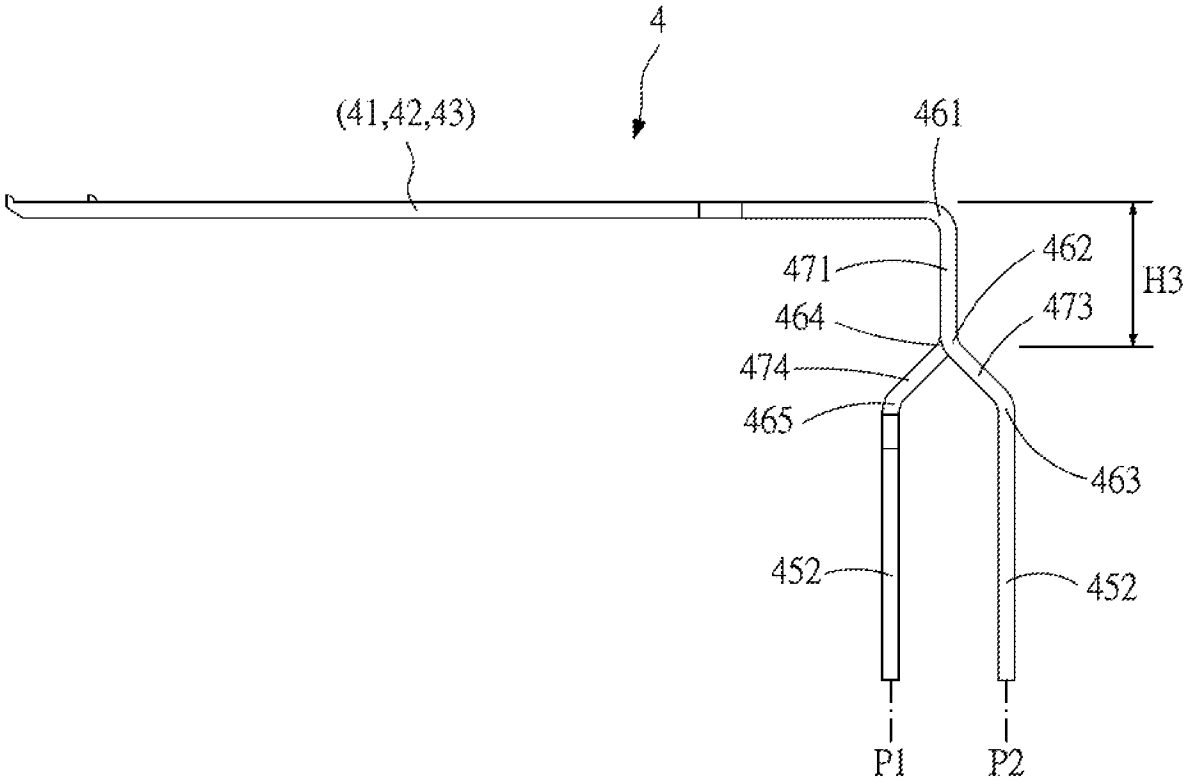
FIG. 7B illustrates a lateral view of the lower-row receptacle terminals of the electrical receptacle connector of the third embodiment.

Please refer to FIGS. 7A and 7B. FIG. 7A illustrates a perspective view of lower-row receptacle terminals of an electrical receptacle connector of a third embodiment of the instant disclosure. FIG. 7B illustrates a lateral view of the lower-row receptacle terminals of the electrical receptacle connector of the third embodiment. In this embodiment, the tail portion 452 of each of the lower-row signal terminals 41 further has a fourth bent portion 464 and a fifth bent portion 465. In addition, a stood portion 471 is defined between the first bent portion 461 and the fourth bent portion 464, an inward-tilting portion 474 is defined between the fourth bent portion 464 and the fifth bent portion 465, the inward-tilting portion 474 extends inwardly, and the stood portion 471 and the inward-tilting portion 474 form an obtuse angle. From a lateral view of the tail portions 452, the inward-tilting portion 474 and the stood portion 471 have a reverse Y profile (or, a fork-like structure). In this embodiment, the tail portion 452 of each of the power terminals 42 and the tail portion 452 of each of the ground terminals 43 also have the three bent portions, i.e., the first bent portion 461, the second bent portion 462, and the third bent portion 463. Hence, the bent portions allow the terminals to have different and non-parallel delivering paths for electromagnetic waves, so that the signals do not interfere with each other easily.

Figure 8A:
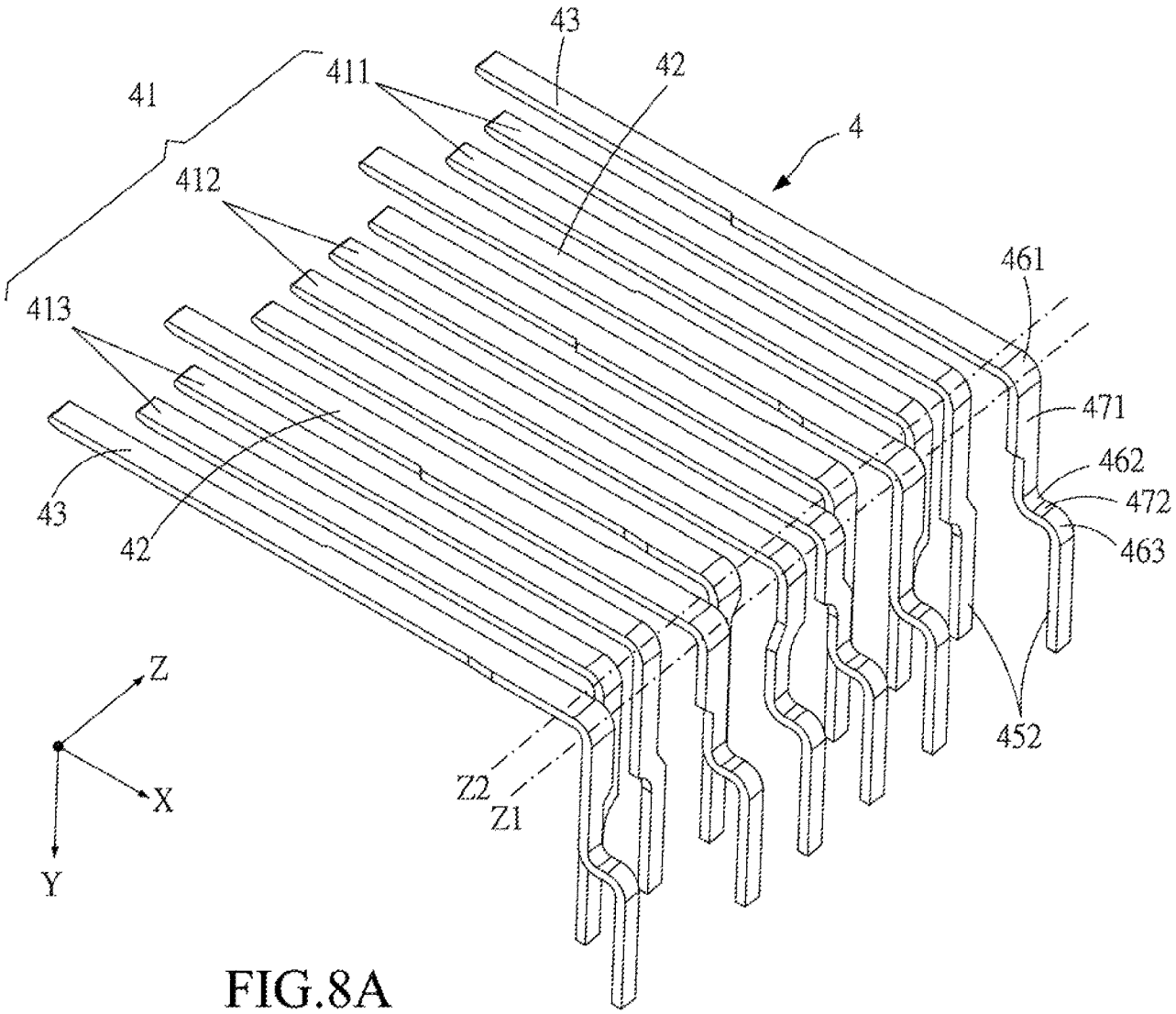
FIG. 8A illustrates a perspective view of lower-row receptacle terminals of an electrical receptacle connector of a fourth embodiment of the instant disclosure.
Figure 8B:
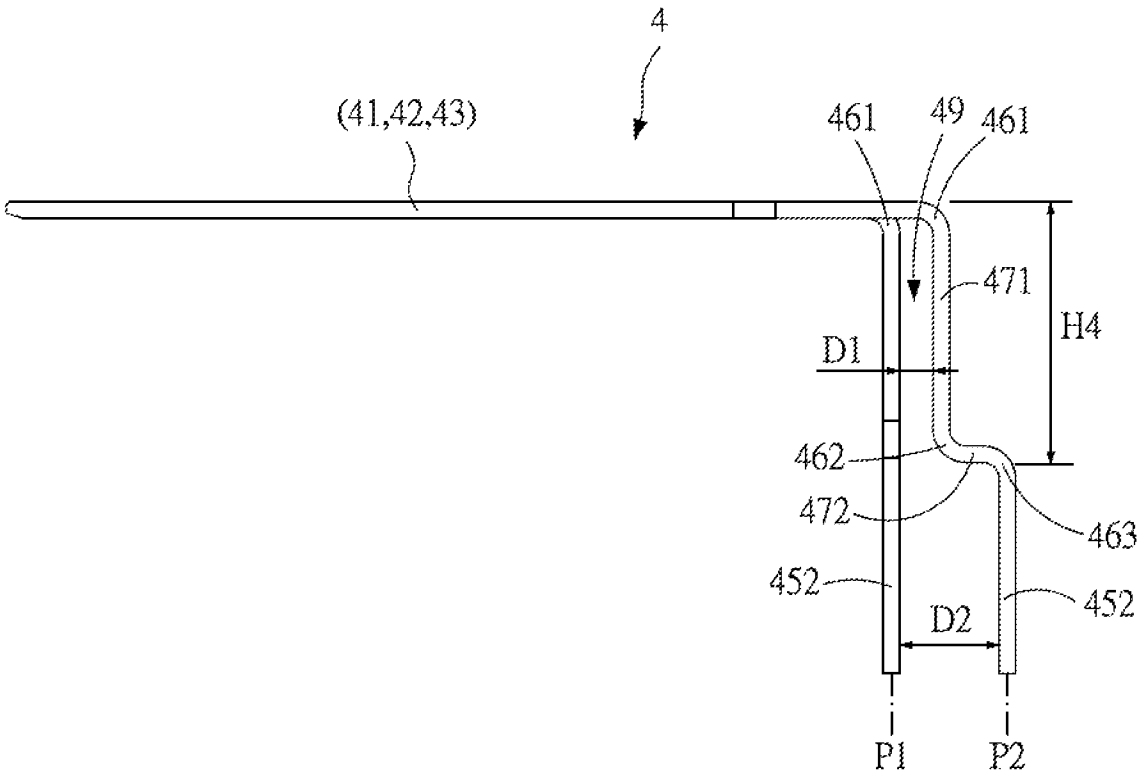
FIG. 8B illustrates a lateral view of the lower-row receptacle terminals of the electrical receptacle connector of the fourth embodiment.

Please refer to FIGS. 8A and 8B. FIG. 8A illustrates a perspective view of lower-row receptacle terminals of an electrical receptacle connector of a fourth embodiment of the instant disclosure. FIG. 8B illustrates a lateral view of the lower-row receptacle terminals of the electrical receptacle connector of the fourth embodiment. In this embodiment, the first bent portions 461 of the power terminals 42 and the first bent portions 461 of the ground terminals 43 are spaced and aligned in a first line Z1, and the first bent portions 461 of the lower-row signal terminals 41 are spaced and aligned in a second line Z2 different to the first line Z1. In this embodiment, a stood portion 471 is also defined between the first bent portion 461 and the second bent portion 462, and a laid portion 472 is also defined between the second bent portion 462 and the third bent portion 463. The stood portion 471 and the laid portion 472 form a right angle, similar to the first embodiment. Furthermore, a first distance D1 is between the first bent portion 461 of each of the lower-row signal terminals 41 and the first bent portion 461 of each of the power terminals 42 as well as the first bent portion 461 of each of the ground terminals 43, a second distance D2 is between the first bent portion 461 and the third bent portion 463 of each of the lower-row signal terminals 41, and the first distance D1 is less than the second distance D2. In this embodiment, the tail portion 452 of each of the power terminals 42 and the tail portion 452 of each of the ground terminals 43 also have three bent portions, i.e., the first bent portion 461, the second bent portion 462, and the third bent portion 463. Hence, the bent portions allow the terminals to have different and non-parallel delivering paths for electromagnetic waves, so that the signals do not interfere with each other easily.

Please refer to FIGS. 5B, 6B, 7B, and 8B. A height difference H1 between the first bent portion 461 and the second bent portion 462 in the first embodiment is greater than a height difference H2 between the first bent portion 461 and the second bent portion 462 in the second embodiment, and is also greater than a height difference H3 between the first bent portion 461 and the second bent portion 462 in the third embodiment. Furthermore, a height difference H4 between the first bent portion 461 and the second bent portion 462 in the fourth embodiment is greater than the height difference H1 between the first bent portion 461 and the second bent portion 462 in the first embodiment. The longer is the height difference, the lower is the second bent portion 462, and the closer is the second bent portion to the circuit board, thus the greater is the reduction of crosstalk interferences.

As above, the tail portions of the power terminals and the tail portions of the ground terminals have three bent portions, i.e., the first bent portion, the second bent portion, and the third bent portion. The bent portions allow the terminals to have different and non-parallel delivering paths for electromagnetic waves, so that the signals do not interfere with each other easily. Moreover, after a first bending procedure, the lower-row receptacle terminals are aligned in a same row, and the first bent portions of the lower-row receptacle terminals are spaced and aligned in a same line. The crosstalk interferences between different pairs of differential signal terminals can be reduced by using non-signal terminals neighboring to the differential signal terminals to separate the different pairs of differential signal terminals. Furthermore, problems caused by the resonance effect can also be reduced. Additionally, regarding the structure of the tail portions of the lower-row receptacle terminals, the material band and the tail portions in vertical alignment are at a same plane; namely, the material band is parallel to the tail portions. Therefore, the volume of the connector can be reduced, so that the electronic device can have still have enough space after the connector is assembled to the electronic device. Moreover, the space between the tail portions allows the tools to be inserted for processing conveniently, so that the manufacturing of the connector can be facilitated.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the upper-row receptacle terminals are in contact with upper-row plug terminals of the electrical plug connector. Conversely, when the electrical plug connector is inserted into the electrical receptacle connector with a second orientation, the flat contact portions of the lower-row receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell comprising a receptacle cavity;

an insulated housing in the receptacle cavity, wherein the insulated housing comprise a base portion and a tongue portion extending from one end of the base portion;

a plurality of upper-row receptacle terminals held in the base portion and the tongue portion; and a plurality of lower-row receptacle terminals comprising a plurality of lower-row signal terminals, a plurality of lower-row power terminals, and a plurality of lower-row ground terminals, wherein the lower-row receptacle terminals are held in the base portion and the tongue portion, wherein each of the lower-row receptacle terminals further comprises a first bent portion and a tail portion outwardly extending from the first bent portion and protruding from the base portion, the tail portion is a vertical leg, the tail portion of each of the lower-row power terminals has a second bent portion and a third bent portion, and the tail portion of each of the lower-row ground terminals has a second bent portion and a third bent portion, the tail portions of the lower-row signal terminals protrude from a bottom of the base portion to be arranged into a first row, the tail portions of the lower-row power terminals and the tail portions of the lower-row ground terminals protrude from the bottom of the base portion to be arranged into a second row, a position of the second row is different from a position of the first row, wherein the lower-row signal terminals comprise a first pair of differential signal terminals, a second pair of differential signal terminals, and a third pair of differential signal terminals, the first pair of differential signal terminals, the second pair of differential signal terminals, and the third pair of differential signal terminals are between the lower-row ground terminals, the lower-row power terminals are respectively between the first pair of differential signal terminals and the second pair of differential signal terminals and between the second pair of differential signal terminals and the third pair of differential signal terminals.

2. The electrical receptacle connector according to claim 1 wherein the tail portion of each of the terminals of the second pair of differential signal terminals has a second bent portion and a third bent portion.

3. The electrical receptacle connector according to claim 1, wherein the first bent portions are spaced and aligned in a same line.

4. The electrical receptacle connector according to claim 3, wherein a stood portion is defined between the first bent portion and the second bent portion, a laid portion is defined between the second bent portion and the third bent portion, and the stood portion and the laid portion form a right angle.

5. The electrical receptacle connector according to claim 3, wherein a stood portion is defined between the first bent portion and the second bent portion, an outward-tilting portion is defined between the second bent portion and the third bent portion, the outward-tilting portion extends outwardly, and the stood portion and the outward-tilting portion form an obtuse angle.

6. The electrical receptacle connector according to claim 5, wherein the tail portion of each of the lower-row signal terminals has a fourth bent portion and a fifth bent portion.

7. The electrical receptacle connector according to claim 6, wherein a stood portion is defined between the first bent portion and the fourth bent portion, an inward-tilting portion is defined between the fourth bent portion and the fifth bent portion, the inward-tilting portion extends inwardly, and the stood portion and the inward-tilting portion form an obtuse angle.

8. The electrical receptacle connector according to claim 1, wherein the first bent portions of the lower-row power terminals and the first bent portions of the lower-row ground terminals are spaced and aligned in a first line, the first bent portions of the lower-row signal terminals are spaced and aligned in a second line different from the first line.

9. The electrical receptacle connector according to claim 8, wherein a stood portion is defined between the first bent portion and the second bent portion, a laid portion is defined between the second bent portion and the third bent portion, and the stood portion and the laid portion form a right angle.

10. The electrical receptacle connector according to claim 9, wherein a first distance is between the first bent portion of each of the lower-row signal terminals and the first bent portion of each of the lower-row power terminals as well as the first bent portion of each of the lower-row ground terminals, a second distance is between the first bent portion and the third bent portion of each of the lower-row signal terminals, and the first distance is less than the second distance.

11. The electrical receptacle connector according to claim 1, wherein the insulated housing further comprises a shielding plate between the base portion and the tongue portion, the shielding plate is between the upper-row receptacle terminals and the lower-row receptacle terminals.

12. The electrical receptacle connector according to claim 2, wherein the third bent portions of the of the power terminals, the third bent portions of ground terminals, and third bent portion of the second pair of differential signal terminals are substantially aligned in a same line.

13. The electrical receptacle connector according to claim 1, wherein the plurality of upper-row receptacle terminals comprising a plurality of upper-row signal terminals, a plurality of upper-row power terminals, and a plurality of upper-row ground terminals.

* * * * *